US009752397B2

(12) United States Patent
Ottersland

(10) Patent No.: US 9,752,397 B2
(45) Date of Patent: Sep. 5, 2017

(54) LIFTING ARRANGEMENT FOR LIFTING A PIPE

(71) Applicant: MHWIRTH AS, Kristiansand (NO)

(72) Inventor: Gjerulf Ottersland, Kristiansand (NO)

(73) Assignee: MHWIRTH AS, Kristiansand (NO)

( * ) Notice: Subject to any disclaimer, the term of this patent is extended or adjusted under 35 U.S.C. 154(b) by 0 days.

(21) Appl. No.: 14/897,649

(22) PCT Filed: Jun. 13, 2014

(86) PCT No.: PCT/IB2014/062191

§ 371 (c)(1),
(2) Date: Dec. 11, 2015

(87) PCT Pub. No.: WO2014/199344

PCT Pub. Date: Dec. 18, 2014

(65) Prior Publication Data

US 2016/0115748 A1 Apr. 28, 2016

(30) Foreign Application Priority Data

Jun. 13, 2013 (NO) ..... 20130828

(51) Int. Cl.
*E21B 19/15* (2006.01)

(52) U.S. Cl.
CPC ..... *E21B 19/155* (2013.01); *E21B 19/15* (2013.01)

(58) Field of Classification Search
CPC ..... E21B 19/155; E21B 19/087; E21B 19/15; E21B 19/20; E21B 19/146; B66C 1/427; F16L 1/065; F16L 1/09
See application file for complete search history.

(56) References Cited

U.S. PATENT DOCUMENTS 3,112,830 A * 12/1963 Podlesak ..... B66C 13/18 294/106
3,860,122 A 1/1975 Cernosek
4,348,920 A * 9/1982 Boyadjieff ..... E21B 19/20 166/77.53
4,552,502 A * 11/1985 Harjar ..... B25J 9/0081 414/680
4,606,695 A * 8/1986 Lenz ..... B25J 9/046 414/735
4,615,656 A * 10/1986 Geraghty, Jr. ..... B66F 9/18 294/103.1

(Continued)

FOREIGN PATENT DOCUMENTS

NO 317081 B1 8/2004
NO 20110638 A1 10/2012

(Continued)

*Primary Examiner* — Gregory Adams
(74) *Attorney, Agent, or Firm* — Norman B. Thot

(57) ABSTRACT

A lifting arm arrangement for lifting a pipe includes a pipe stacking tool comprising a first end, a second end, and a pipe handling head arranged at the second end. The pipe handling head is configured to grip around the pipe. A gripper head is connected to the first end of the pipe stacking tool. A tilt shaft is configured to connect the pipe stacking tool and the gripper head so as to form an articulated joint. The articulated joint comprises a locked position in which the pipe stacking tool is prevented from tilting about the tilt shaft, and a neutral position in which the pipe stacking tool is allowed to tilt about the tilt shaft.

19 Claims, 9 Drawing Sheets

(56) References Cited

U.S. PATENT DOCUMENTS

| | | | | |
|---|---|---|---|---|
| 6,220,807 | B1 * | 4/2001 | Sorokan | E21B 19/155 166/77.52 |
| 6,280,119 | B1 * | 8/2001 | Ryan | B66C 1/425 294/104 |
| 6,527,493 | B1 | 3/2003 | Kamphorst et al. | |
| 7,794,192 | B2 * | 9/2010 | Wright | E21B 19/20 414/22.65 |
| 8,235,104 | B1 | 8/2012 | Sigmar et al. | |
| 8,425,171 | B2 * | 4/2013 | Mortensen | E21B 19/146 211/70 |
| 8,506,229 | B2 * | 8/2013 | Orgeron | E21B 19/155 414/22.55 |
| 2012/0297933 | A1 * | 11/2012 | Lavalley | E02F 3/965 81/57.34 |
| 2013/0302114 | A1 * | 11/2013 | Reddy | E21B 3/02 414/22.55 |

FOREIGN PATENT DOCUMENTS

| | | | | |
|---|---|---|---|---|
| WO | WO 2004/018829 | A1 | 3/2004 | |
| WO | WO 2005073497 | A1 * | 8/2005 | E21B 19/155 |
| WO | WO 2010128119 | A3 * | 1/2011 | E21B 19/15 |
| WO | WO 2012/148286 | A1 | 11/2012 | |

* cited by examiner

LIFTING ARRANGEMENT FOR LIFTING A PIPE

CROSS REFERENCE TO PRIOR APPLICATIONS

This application is a U.S. National Phase application under 35 U.S.C. §371 of International Application No. PCT/M2014/062191, filed on Jun. 13, 2014 and which claims benefit to Norwegian Patent Application No. 20130828, filed on Jun. 13, 2013. The International Application was published in English on Dec. 18, 2014 as WO 2014/199344 A2 under PCT Article 21(2).

FIELD

The present invention relates to a lifting arm arrangement for lifting a pipe, and to a method for alternating between a position in which a pipe stacking tool is locked and a neutral position in which the pipe stacking tool can tilt.

BACKGROUND

The lifting arm arrangement according to the present invention is used in connection with a pipe handling machine for lifting pipes from a horizontal position to a vertical position. When the pipes are in the horizontal position, they can, for example, be placed on a loading unit or stacked in a pipe store or the like.

When the pipes are brought into the vertical position, they are in a pipe stacking position and can then be put together to form a drill string. The individual pipes are thereby made up into stands that are stored in the vertical position in a suitable area on the drill floor. The stands are moved from this storage area to a well center as required, either when a drill string is to be made up or in connection with drilling when there is a need to extend the existing drill string with additional stands.

The lifting arm arrangement according to the present invention may be secured to a vertical column structure and can, for example, be secured to one or more carriages that are moved in a vertical direction along the vertical column structure in order to raise and lower the lifting arm arrangement.

The lifting arm arrangement according to the present invention can also be equipped with a pipe handling head that is used to grip around the pipe when it is to be lifted from a horizontal to a vertical position. The pipe handling head is secured to one end of the pipe stacking tool. The other end of the pipe stacking tool is connected to a gripper head, which is in turn mounted on a gripper head arm that is arranged to mount to the vertical column structure. The gripper head arm is able to move the gripper head relative to the vertical column structure in the horizontal direction.

Relatively large forces act on the pipe handling head when the pipe handling head grips around the pipe and lifts it from its horizontal position. These forces are transferred as torque forces to the gripper head. In the lifting process, one pipe end is firmly held by the pipe handling head, while the other pipe end hangs down so that the pipe has an inclination. The loading unit may then come to push against the hanging end of the pipe. This is a situation in which major forces will act on the pipe handling head and where the forces will be transferred as torque forces to the gripper head.

A problem in existing embodiments is that the gripper head is subjected to major torque forces when the pipe handling head is loaded, and the equipment thus sustains damage or is rendered ineffective as a result.

SUMMARY

An aspect of the present invention is to provide a solution to the above problem.

In an embodiment, the present invention provides a lifting arm arrangement for lifting a pipe which includes a pipe stacking tool comprising a first end, a second end, and a pipe handling head arranged at the second end. The pipe handling head is configured to grip around the pipe. A gripper head is connected to the first end of the pipe stacking tool. A tilt shaft is configured to connect the pipe stacking tool and the gripper head so as to form an articulated joint. The articulated joint comprises a locked position in which the pipe stacking tool is prevented from tilting about the tilt shaft, and a neutral position in which the pipe stacking tool is allowed to tilt about the tilt shaft.

BRIEF DESCRIPTION OF THE DRAWINGS

The present invention is described in greater detail below on the basis of embodiments and of the drawings in which.

DETAILED DESCRIPTION

Figure 1:
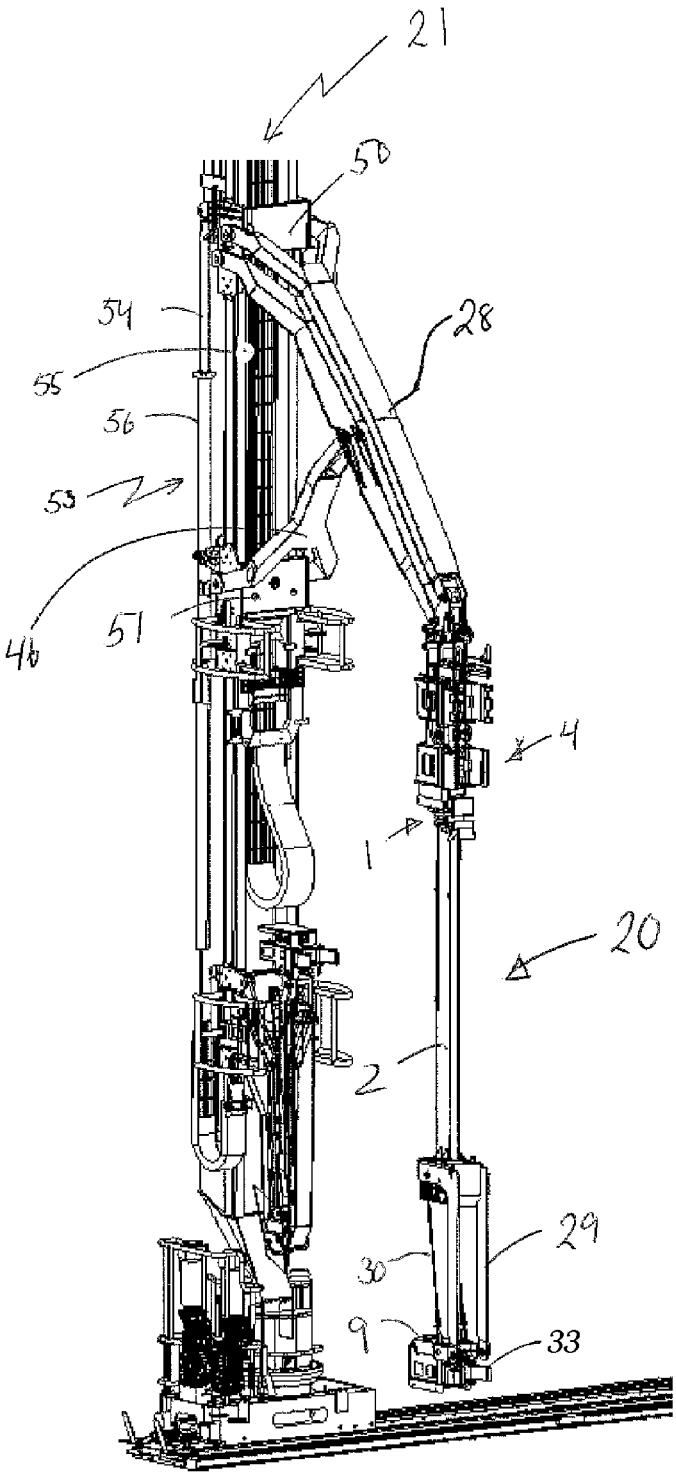
FIG. 1 shows a pipe handling machine without load in the pipe handling head.

In an embodiment of the present invention, the pipe stacking tool and the gripper head are articulated to a tilt shaft. This articulated joint has a locked position in which the pipe stacking tool is prevented from tilting about the tilt shaft, and a neutral position in which the pipe stacking tool is allowed to tilt about the tilt shaft relative to the gripper head. If the pipe stacking tool is load stressed with the articulated joint in the neutral position, the pipe stacking tool is allowed to tilt about the tilt shaft, thereby preventing the forces from being transferred as torque to the gripper head. The pipe stacking tool can be load stressed in different ways, but major frictional forces that act on the pipe stacking tool may in particular be transferred as torque forces to the gripper head when pipes are to be pulled from the loading unit and the pipe load is to be transferred to the pipe stacking tool.

The articulated joint can be moved between its neutral position and its locked position in that the pipe stacking tool, together with the tilt shaft, is turned about the axial axis of the pipe stacking tool. The pipe stacking tool can be rotated between a position in which the pipe stacking tool in the neutral position of the articulated joint can be allowed to tilt about the tilt axis, and a position in which the pipe stacking tool in the locked position of the articulated joint is prevented from tilting about the tilt axis.

In an embodiment of the present invention, the lifting arm arrangement can, for example, be provided with a rotary arm that is pivotally connected to the gripper head. The rotary arm can be configured with a bore and will be connected to the pipe stacking tool in that the tilt axis is passed through both the bore of the rotary arm and a bore in the pipe stacking tool. When the rotary arm is turned, the tilt shaft and the pipe stacking tool will then rotate as a result of the rotational movement of the rotary arm, and the articulated joint can be moved between its neutral position and its locked position. An actuator, for example, a cylinder with piston, can be used to turn the rotary arm between the neutral position and the locked position of the articulated joint.

To facilitate the locking and neutral positioning of the articulated joint, an embodiment of the present invention provides that the lifting arm arrangement can, for example, be provided with a locking sleeve. The locking sleeve can be connected to the gripper head, and may be configured with at least one locking face that is positioned in contact with at least one stop face provided on the pipe stacking tool. The stop face(s) can be configured on the end face of the pipe stacking tool facing the gripper head, and the locking sleeve locking face(s) can be constituted of the end face(s) of the locking sleeve. According to this embodiment, the locking face(s) has/have an extent in the radial direction of the locking sleeve and in the circumferential direction of the locking sleeve. The stop faces of the pipe stacking tool have an extent in the radial direction of the pipe stacking tool and in the circumferential direction of the pipe stacking tool. When the articulated joint is in its locked position, the stop face(s) of the pipe stacking tool abuts/abut in contact with the locking face(s) of the locking sleeve in the axial direction. In the neutral position of the articulated joint, the stop face(s) of the pipe stacking tool is/are released from the locking face(s) of the locking sleeve, and the pipe stacking tool can then be tilted relative to the gripper head. In an embodiment of the present invention, the locking sleeve can, for example, be configured with recesses of a shape that is suitable for receiving the stop faces of the pipe stacking tool. When the pipe stacking tool has been turned to its neutral position in which the stop face(s) of the pipe stacking tool has/have been released from the locking face(s) of the locking sleeve, and the pipe stacking tool tilts about the tilt shaft, the stop faces of the pipe stacking tool are moved into the locking sleeve recesses.

Alternative locking device to the locking sleeve as described here are possible. It is important to permit the articulated joint to alternate between a neutral position, in which the pipe stacking tool can tilt about the tilt shaft, and a locked position, in which the pipe stacking tool is prevented from tilting about the tilt shaft.

In an embodiment of the present invention, the locking can, for example, take place in that the locking sleeve has locking faces that are positioned to overlap with the pipe stacking tool stop faces so that tilting is prevented by the faces abutting against each other in the radial direction. In this embodiment, the locking sleeve locking face(s) can then be constituted of at least one face that has a surface extent in the axial direction of the locking sleeve and in the circumferential extent of the locking sleeve. The pipe stacking tool stop face(s) can also be constituted of at least one face that has a surface extent in the axial direction of the pipe stacking tool and in the circumferential direction of the pipe stacking tool. In this embodiment, the locking sleeve locking face(s) can be positioned on the inside or outside of the pipe stacking tool stop faces so that locking can take place by the axially oriented faces being moved into abutment with each other in the radial direction so as to prevent tilting.

The present invention also comprises a method for alternating between a position in which the pipe stacking tool is locked and a neutral position in which the pipe stacking tool is allowed to tilt as a result of load stress on the pipe stacking tool. According to this method, the pipe stacking tool and the tilt shaft are rotated about the axial axis of the pipe stacking tool relative to the gripper head in order to alternate between the neutral position of the articulated joint, in which the pipe stacking tool is free to tilt about the tilt shaft, and the locked position of the articulated joint, in which the pipe stacking tool is locked and prevented from tilting about the tilt axis.

The present invention will be explained below in the form of an example with reference to the drawings.

Figure 2:
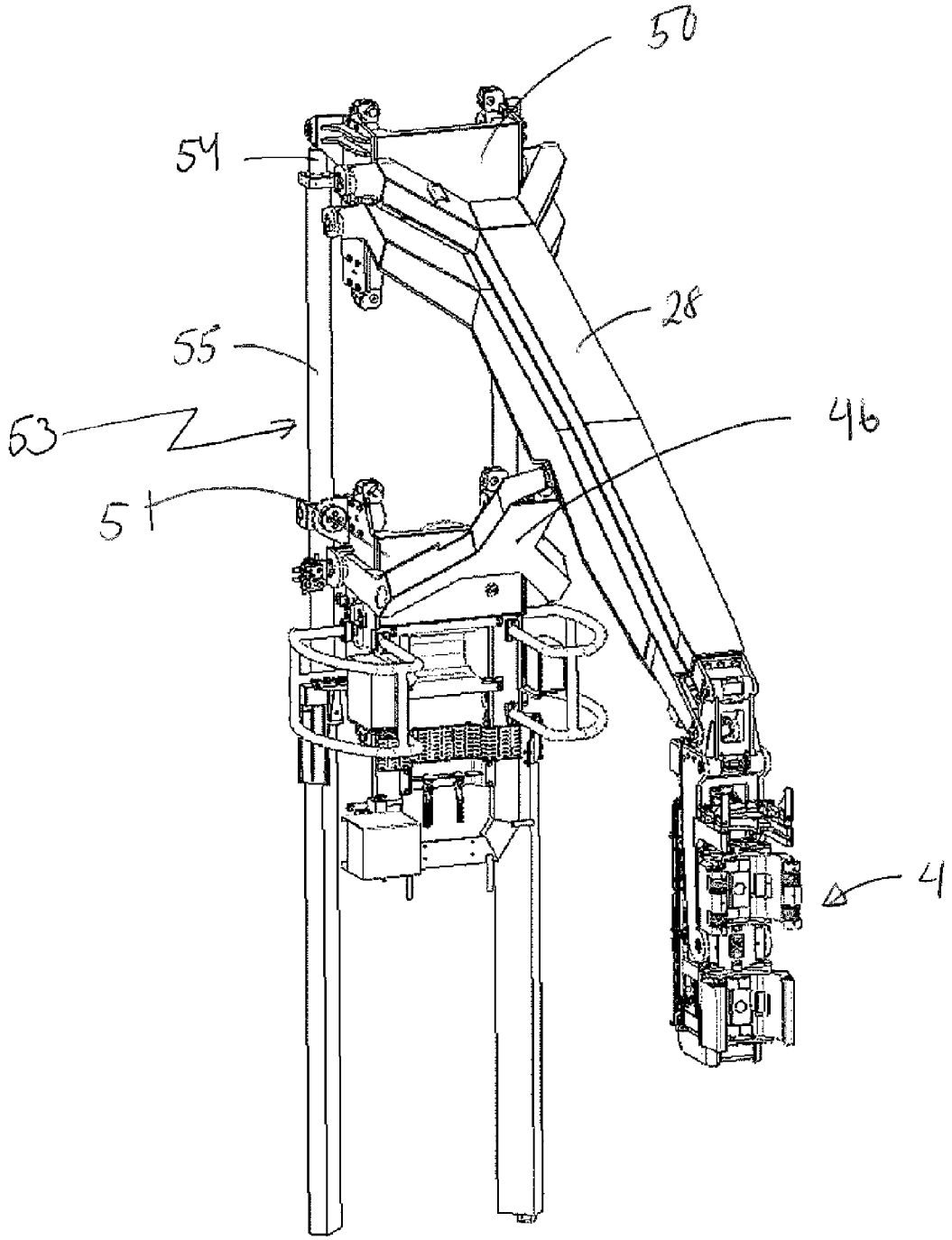
FIG. 2 shows a part of the pipe handling machine as shown in FIG. 1.

FIG. 1 shows a lifting arm arrangement 20 comprising a pipe stacking tool 2 and a pipe handling head 9 that is used to grip around one end of the pipe when the pipe is to be lifted from its horizontal position. The upper end of the pipe stacking tool 2 is secured to a gripper head 4 by an articulated joint 1. FIG. 2 shows the gripper head 4 connected to a gripper head arm 28 that is secured to an upper dolly 50. A lifting arm 46 is connected to a lower dolly 51 at one of its ends, while the other end of the lifting arm 46 is connected to the gripper head arm 28. The lower dolly 51 and the upper dolly 50 are slidably fastened to at least one lifting cylinder 53, as is clearly shown in FIG. 2. The lifting cylinder 53 comprises a piston rod 54 and a cylinder 56. The lower dolly 51 is fastened to the cylinder 56, and the upper dolly 50 is fastened to the piston rod 54. On movement of the piston rod 54, the upper dolly 50 moves relative to the lower dolly 51, and through this movement, the gripper head arm 28 is turned inwards towards or outwards from the lifting cylinder 53. The gripper head 4 follows the movement of the gripper head arm and is moved in the horizontal direction towards or away from the lifting cylinder 53.

In FIG. 2, the piston rod 54 is shown received in the cylinder 56, and the upper dolly 50 is then in a lower position. The gripper head 4 in this position is placed at a maximum horizontal distance from the lifting cylinder 53. When the piston rod 54 is pushed from the position shown in FIG. 2, the upper dolly 50 is moved upwards. FIG. 1 shows the piston rod 54 in a position in which it is withdrawn from the cylinder 56 and where the upper dolly 50 has been moved upwards. The gripper head arm 28 is then turned inwards towards the lifting cylinder 53, and the gripper head 4 is moved closer to the lifting cylinder 53.

The upper dolly 50 is slidably secured to rails 55 on a vertical column structure 21 as is shown in FIG. 1. The upper dolly 50 will then slide along the rails 55 when it is moved to a new position on movement of the piston rod 54.

It may also be desirable to carry out a vertical movement of the whole system, i.e., move the lifting cylinder 53, carriages with gripping arms and lifting arms to another position on the vertical column structure 21. For this purpose, a winch is used that is fastened to the top end of the vertical column structure 21 and a wire that runs from the winch to attachment in the lower dolly 51.

The articulated joint 1 has a locked position and a neutral position and the position of the pipe stacking tool 2 relative to the gripper head 4 determines whether the articulated joint 1 should be in a locked position or in a neutral position. In FIG. 1, the pipe stacking tool 2 has been turned to a position in which the articulated joint 1 is in a locked position, and the pipe handling head 9 is shown in a drawn-up position.

Figure 3:
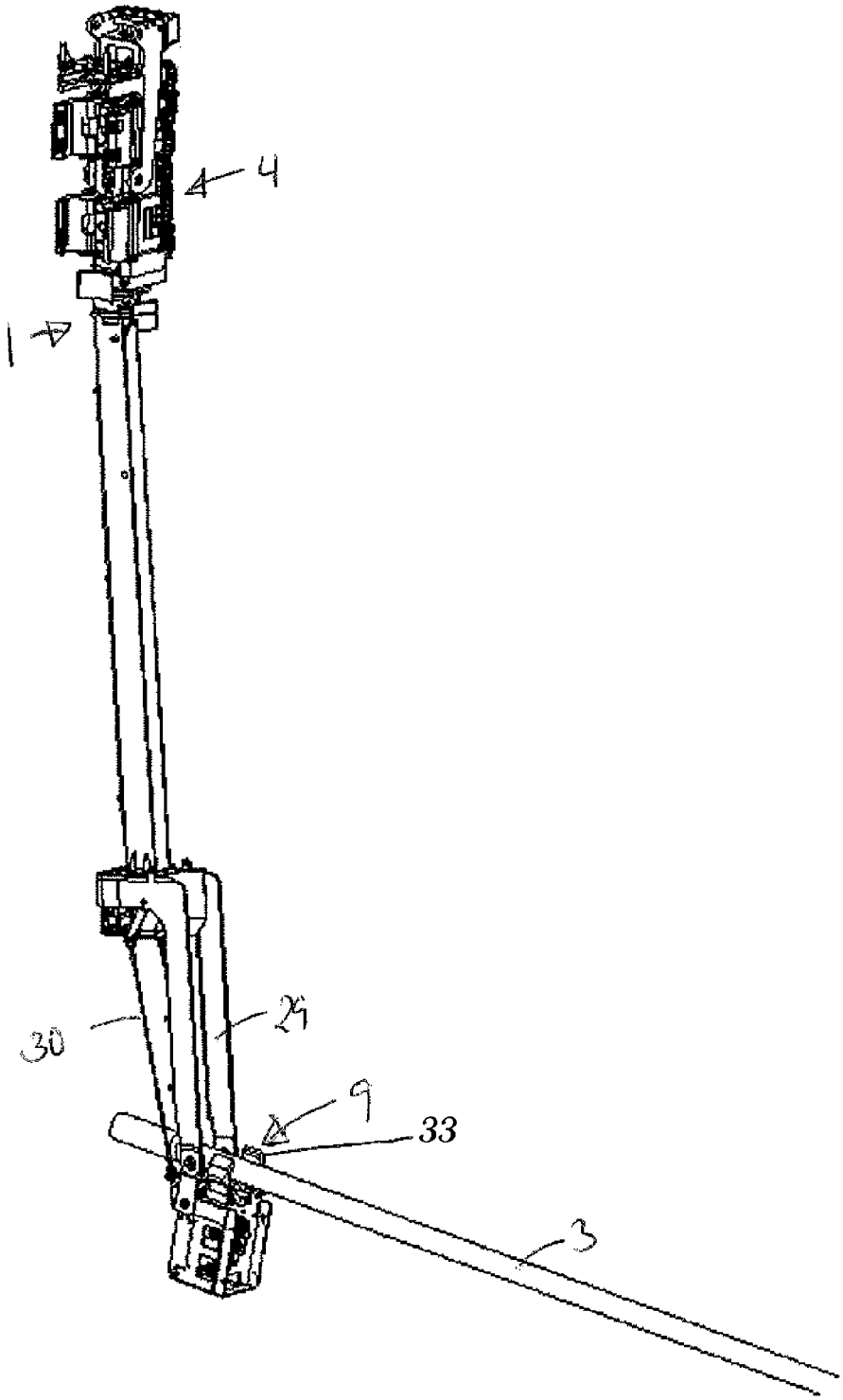
FIG. 3 shows the pipe handling machine with a load in the pipe handling head.

The pipe handling head 9, which is fastened by arms 29 to the pipe stacking tool 2, can be moved from a drawn-up position, as is shown in FIG. 1, to an operative position, as is shown in FIG. 3, by adjusting the lines 30. The pipe stacking tool 2 has been turned approximately 90 degrees using an actuator 8, as can be seen in FIGS. 4-8, from the neutral position in FIG. 1, in which the articulated joint 1 has been placed in the locked position, into the neutral position of the articulated joint 1, in which the pipe handling head 9 is made ready to receive a pipe 3. When a pipe 3 is to be handled, the pipe handling head 9 is moved down to a position in which the pipe gripping jaws 33 face upwards, for example, in that the lines 30 are slackened so that the pipe handling head 9 can be lowered. A pipe 3 is run from its horizontal position in a tubular loading unit (not shown), and the end of the pipe 3 is passed in between the arms 29 and brought to rest between the pipe gripping jaws 33 of the pipe handling head 9. A sensor (not shown) is disposed between the pipe gripping jaws 33. When the pipe end has been placed between the pipe gripping jaws 33, this is registered by the sensor and a signal is given that the pipe gripping jaws 33 can close around the pipe end. The pipe 3 can now be lifted with the lower end of the pipe 3 still resting in the loading unit. When the pipe 3 is drawn up from this position, a frictional force arises between the pipe end and the surface on which the pipe end rests in the loading unit. As the articulated joint 1 is in a neutral position, this frictional force causes the pipe stacking tool 2 to be tilted into a position as is shown in FIG. 3. If the attachment between the pipe stacking tool 2 and the gripper head 4 had been rigid, or the articulated joint 1 were in a locked position, this frictional force would be transferred to the gripper head 4 as a torque force. As the articulated joint 1 between the gripper head 4 and the pipe stacking tool 2 is in a neutral position and the pipe stacking tool 2 is free to tilt, the gripper head 4 is spared from large force stresses. It may also be the case that the loading unit pushes against the lower end of the pipe, and with the articulated joint 1 in a neutral position, the pipe stacking tool 2 will then be tilted in a direction away from the loading unit as shown in FIG. 3.

Figure 4:
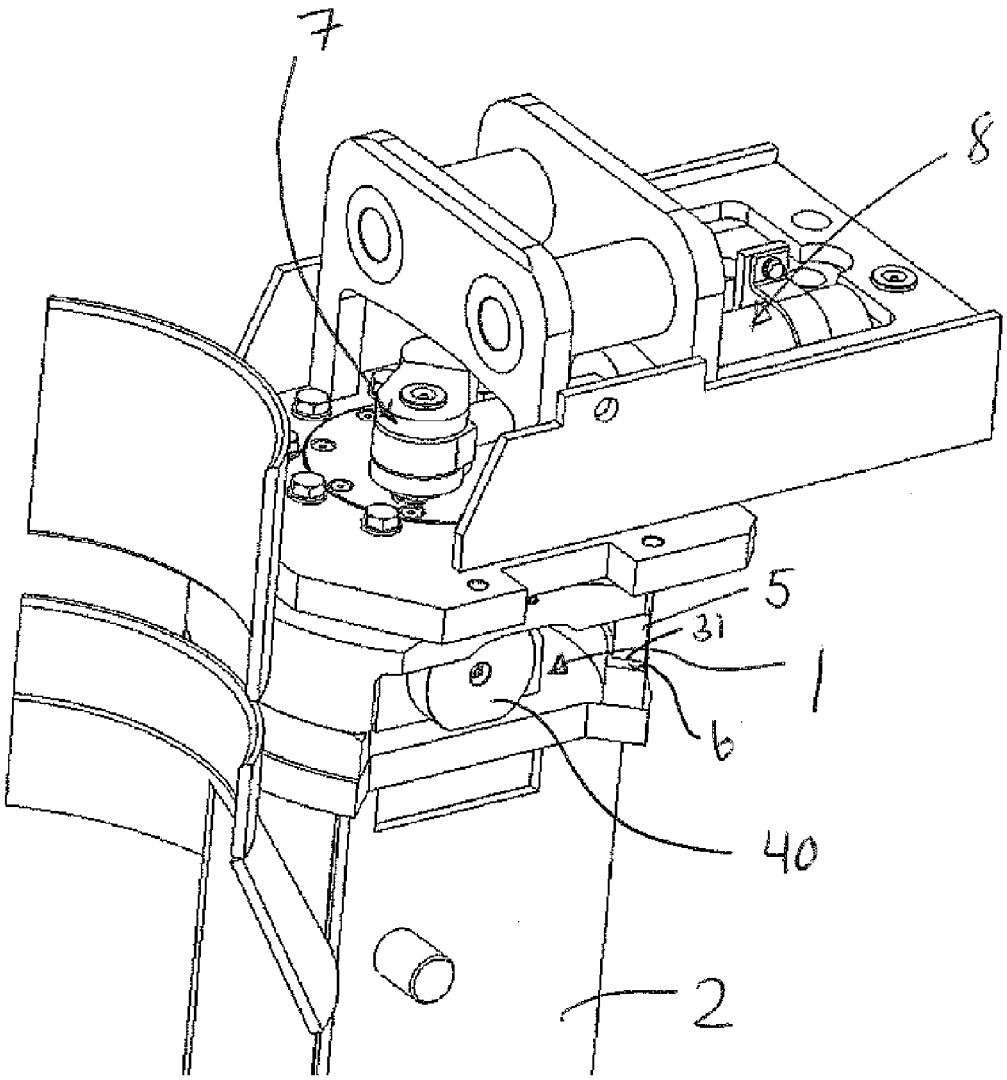
FIG. 4 shows the articulated joint in a locked position.

The articulated joint is shown in more detail in FIGS. 4-8. It can here be seen that the pipe handling tool 2 and a tilt shaft 40 connecting the pipe handling tool 2 to the gripper head 4 in that the tilt shaft 40 is supported in a bore 44 through the pipe handling tool 2 and through a bore 47 formed in a rotary arm 7. The articulated joint 1 is seen in the locked position in FIG. 4. A locking sleeve 5 is fastened to the gripper head 4 by bolts 60. The locking sleeve 5 has locking faces 31 which in FIG. 4 are shown abutting against stop faces 6 on the pipe handling tool 2. In this position, the articulated joint 1 is in its locked position, and the abutment of the locking faces 31 against the stop faces 6 prevents the pipe handling tool 2 from being able to tilt relative to the gripper head 4.

Figure 5:
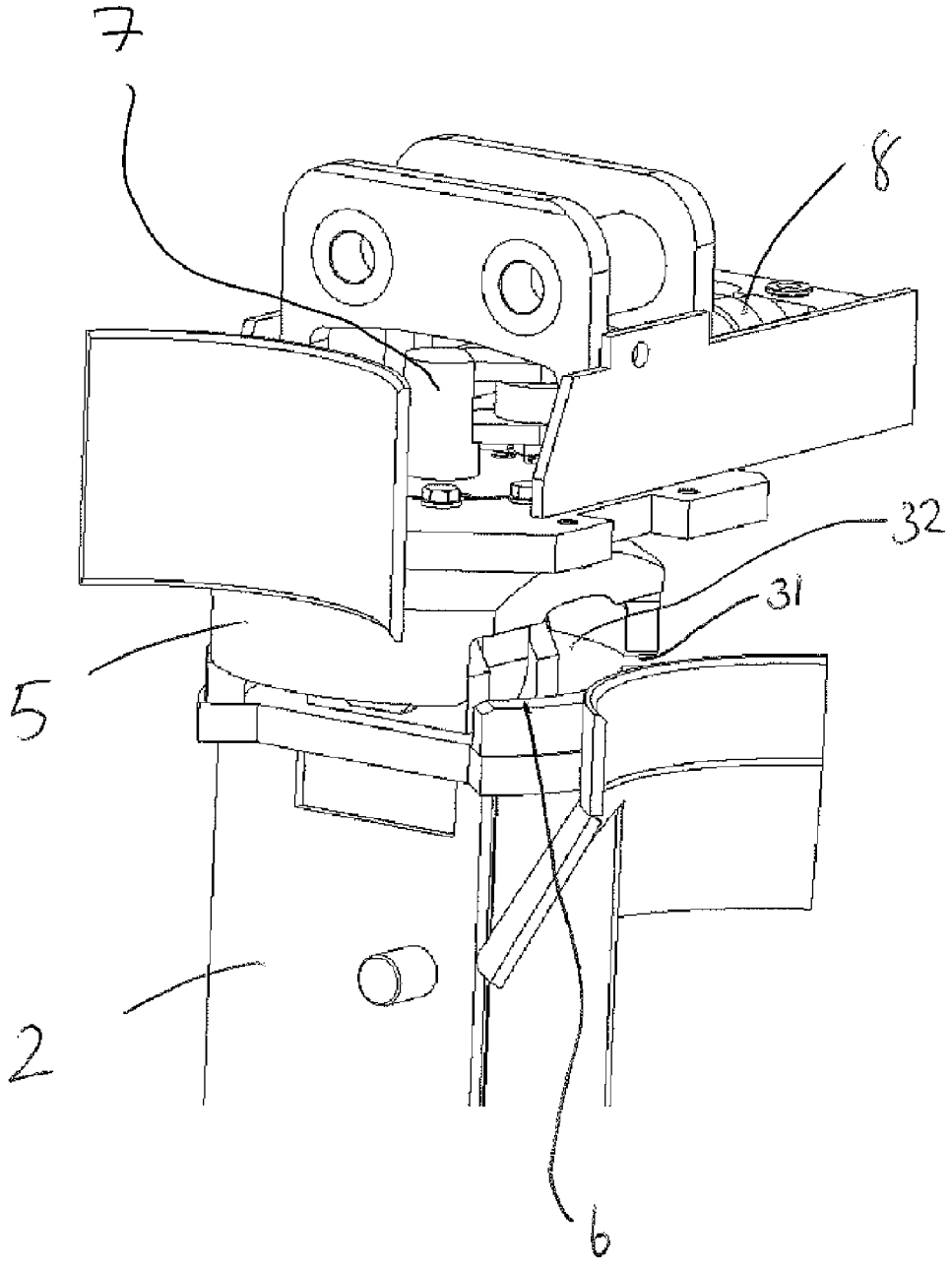
FIG. 5 shows the articulated joint in a neutral position.
Figure 6:
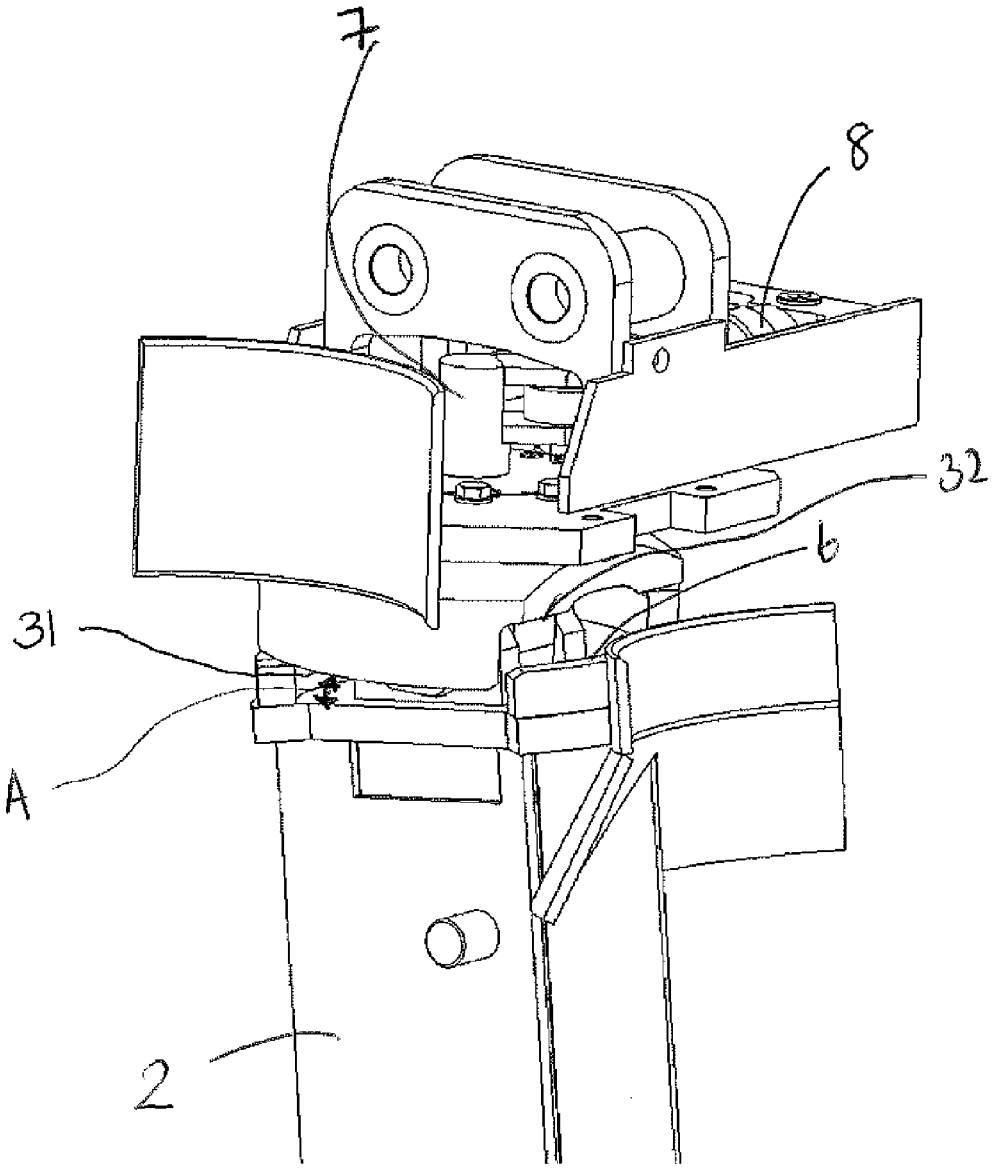
FIG. 6 shows the articulated joint in a neutral position with the pipe stacking tool tilted about the tilt shaft.

When the pipe handling tool 2 has been rotated into the position shown in FIG. 5, approximately 90 degrees relative to the position shown in FIG. 3, the stop faces 6 have been moved out of abutment against the locking faces 31. The locking sleeve has recesses 32 which are of such size that when the pipe handling tool 2 is tilted about the tilt shaft 40, the stop faces 6 fit into the recesses 32. The tilting movement that occurs when the pipe handling tool 2 is load stressed in its neutral position is shown illustrated by an angular deviation A, as shown in FIG. 6.

Figure 7:
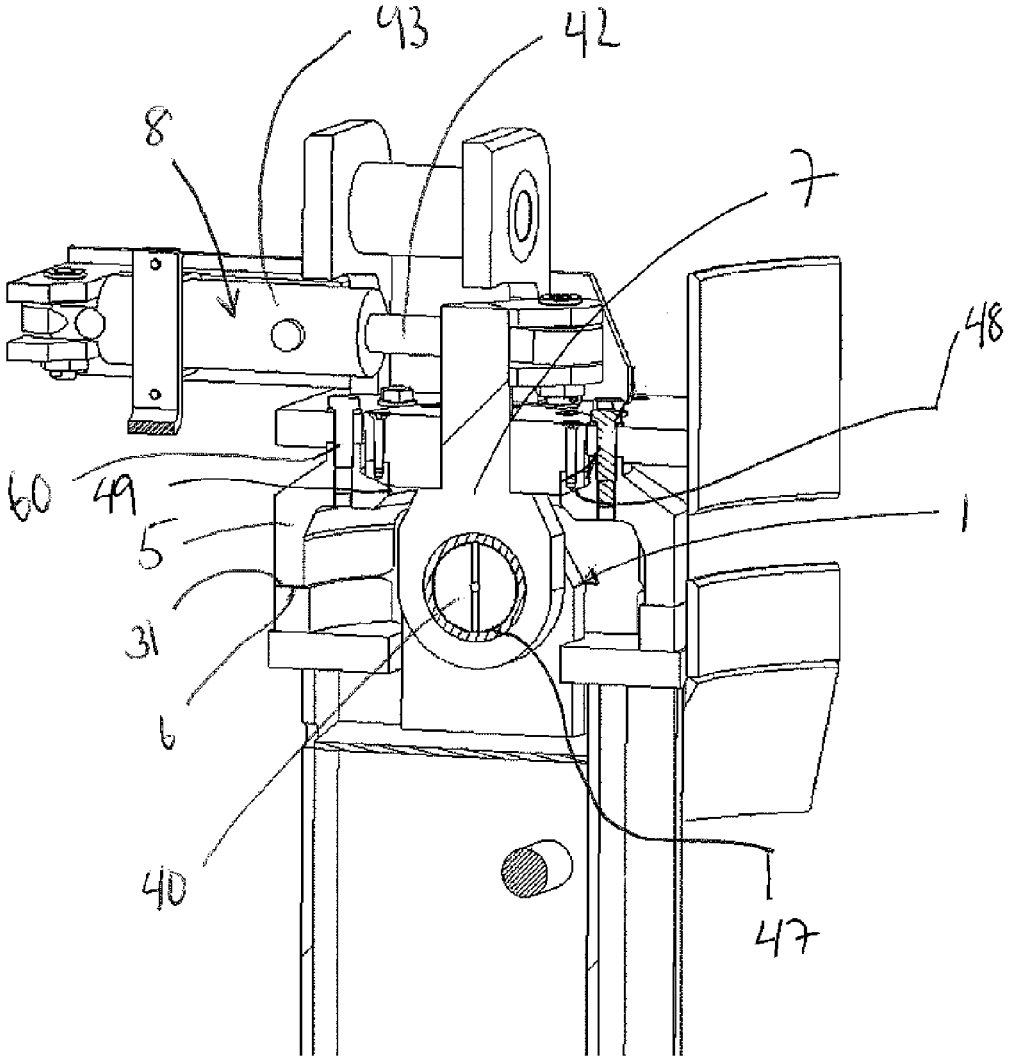
FIG. 7 shows an axial section through the articulated joint when it is in its locked position.
Figure 8:
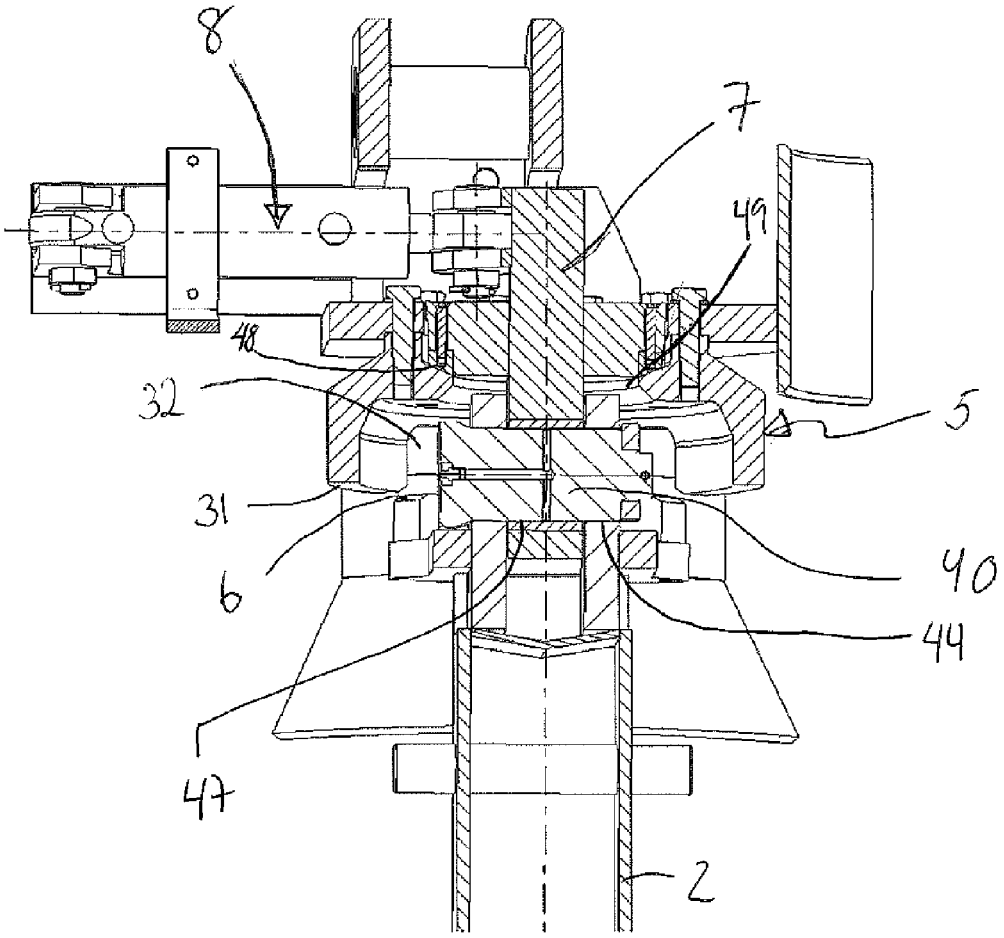
FIG. 8 shows an axial section through the articulated joint in a neutral position, the section being taken perpendicular to the axial section shown in FIG. 7.
Figure 9:
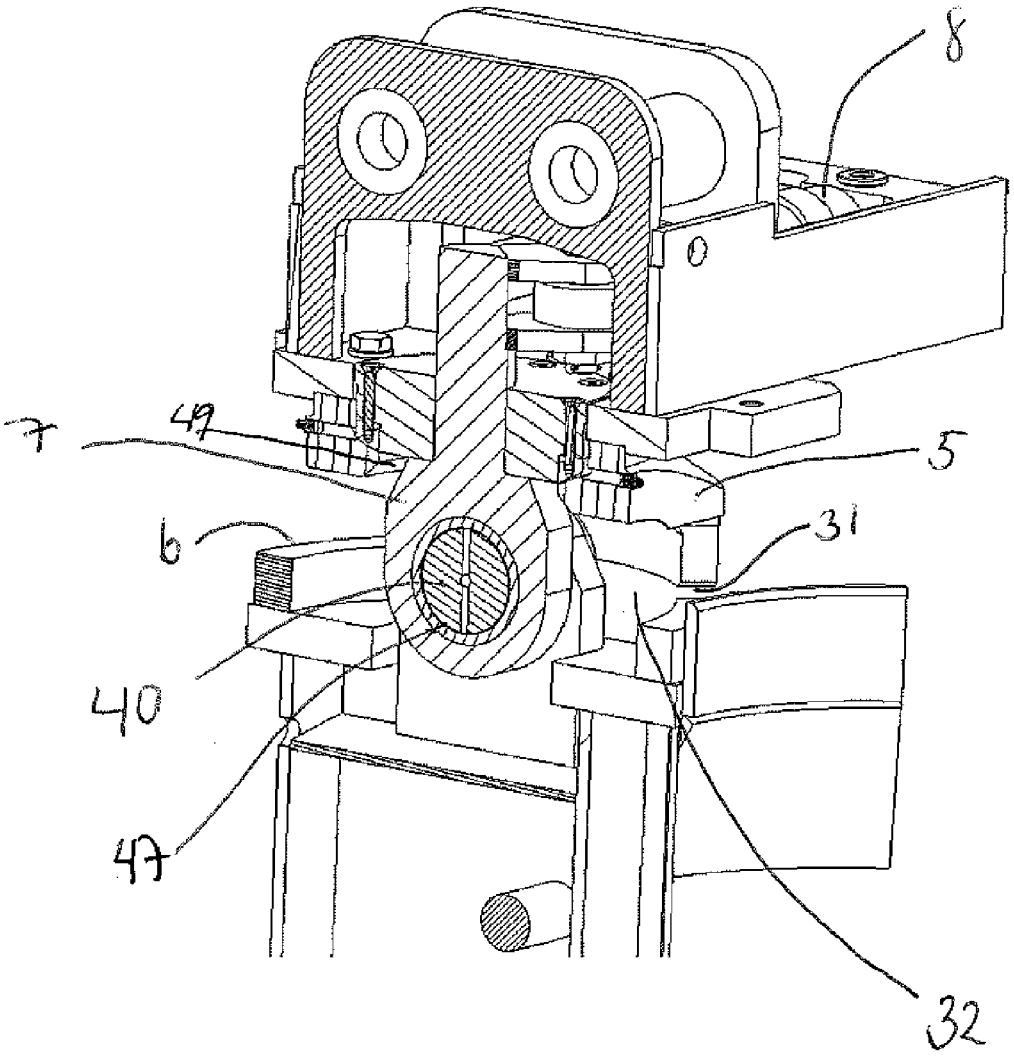
FIG. 9 shows an axial section through the articulated joint when it is in a neutral position.

FIGS. 7 and 8 show an axial section through the articulated joint 1 when it is in a locked state. FIG. 9 shows an axial section through the articulated joint 1 when the rotary arm 7 has rotated the pipe handling tool 2 into a neutral position. The rotary arms 7 are supported in the locking sleeve 5 in abutment with contact faces 48 in the locking sleeve 5. The contact faces 48 run around the circumference of a bore 49 in the locking sleeve 5. Arranged in the bore 49 is the rotary arm 7 that is mounted to the pipe handling tool 2, and the articulated joint 1 in connection with this arrangement is inside the locking sleeve 5. The rotary arm 7 is turned by the actuator 8 that is shown comprising a cylinder 43 and a piston 42. By this rotational movement, the rotary arm 7 is rotated into abutment with the contact faces 48, and the articulated joint 1 is moved between the locked position as shown in FIG. 6 and the neutral position as shown in FIGS. 7 and 8. By drawing the piston 42 out of the cylinder 43, the rotary arm 7 is rotated into a position in which the locking faces 31 are brought into abutment with the stop faces 6 of the locking cup. Alternatively, the piston can be pushed into the cylinder 43 so that the locking faces 31 are released from abutment against the stop faces 6 of the locking cup, as shown in FIG. 8. The actuator 8 can of course be provided in another way than by using a piston and cylinder, and if a cylinder with piston is used, different piston positions can be employed to determine the locking position and the neutral position.

The present invention is not limited to embodiments described herein; reference should be had to the appended claims.

What is claimed is:

1. A lifting arm arrangement for lifting a pipe, the lifting arm arrangement comprising:

a pipe stacking tool comprising a first end, a second end, and a pipe handling head arranged at the second end, the pipe handling head being configured to grip around the pipe;

a gripper head connected to the first end of the pipe stacking tool;

a tilt shaft configured to connect the pipe stacking tool and the gripper head so as to form an articulated joint, the articulated joint comprising a locked position in which the pipe stacking tool is prevented from tilting about the tilt shaft, and a neutral position in which the pipe stacking tool is allowed to tilt about the tilt shaft; and a rotary arm comprising a rotary arm bore, the rotary arm being pivotally connected to the gripper head, wherein, the tilt shaft is passed through the rotary arm bore, and the rotary arm is configured to turn the tilt shaft and the pipe stacking tool between the neutral position and the locked position of the articulated joint.

2. The lifting arm arrangement as recited in claim 1, wherein, the pipe stacking tool further comprises at least one bore, and the tilt shaft is supported in the gripper head and is connected to the pipe stacking tool in that the tilt shaft passes through the at least one bore.

3. The lifting arm arrangement as recited in claim 1, wherein, the rotary arm is further configured to turn the pipe stacking tool and the tilt shaft about an axial direction of the pipe stacking tool.

4. The lifting arm arrangement as recited in claim 1, further comprising:

an actuator configured to turn the rotary arm between the neutral position and the locked position of the articulated joint.

5. The lifting arm arrangement as recited in claim 1, further comprising:

a locking sleeve connected to the gripper head, the locking sleeve comprising at least one locking face; and at least one stop face arranged on the pipe stacking tool;

wherein, the at least one locking face is positioned to contact with the at least one stop face in the locked position of the articulated joint.

6. The lifting arm arrangement as recited in claim 5, wherein the locking sleeve further comprises recesses configured to receive the at least one stop face when the articulated joint is in the neutral position.

7. A lifting arm arrangement for lifting a pipe, the lifting arm arrangement comprising:

a pipe stacking tool comprising a first end, a second end, and a pipe handling head arranged at the second end, the pipe handling head being configured to grip around the pipe;

a gripper head connected to the first end of the pipe stacking tool;

a tilt shaft configured to connect the pipe stacking tool and the gripper head so as to form an articulated joint, the articulated joint comprising a locked position in which the pipe stacking tool is prevented from tilting about the tilt shaft, and a neutral position in which the pipe stacking tool is allowed to tilt about the tilt shaft;

a locking sleeve connected to the gripper head, the locking sleeve comprising at least one locking face; and at least one stop face arranged on the pipe stacking tool, wherein, the at least one locking face is positioned to contact with the at least one stop face in the locked position of the articulated joint.

8. The lifting arm arrangement as recited in claim 7, wherein, the pipe stacking tool further comprises at least one bore, and the tilt shaft is supported in the gripper head and is connected to the pipe stacking tool in that the tilt shaft passes through the at least one bore.

9. The lifting arm arrangement as recited in claim 7, further comprising:

a rotary arm comprising a rotary arm bore, the rotary arm being pivotally connected to the gripper head, wherein, the tilt shaft is passed through the rotary arm bore.

10. The lifting arm arrangement as recited in claim 9, wherein the rotary arm is configured to turn the tilt shaft and the pipe stacking tool between the neutral position and the locked position of the articulated joint.

11. The lifting arm arrangement as recited in claim 10, wherein, the rotary arm is further configured to turn the pipe stacking tool and the tilt shaft about an axial direction of the pipe stacking tool.

12. The lifting arm arrangement as recited in claim 9, further comprising:

an actuator configured to turn the rotary arm between the neutral position and the locked position of the articulated joint.

13. The lifting arm arrangement as recited in claim 7, wherein the locking sleeve further comprises recesses configured to receive the at least one stop face when the articulated joint is in the neutral position.

14. A lifting arm arrangement for lifting a pipe, the lifting arm arrangement comprising:

a pipe stacking tool comprising a first end, a second end, and a pipe handling head arranged at the second end, the pipe handling head being configured to grip around the pipe;

a gripper head connected to the first end of the pipe stacking tool;

a tilt shaft configured to connect the pipe stacking tool and the gripper head so as to form an articulated joint, the articulated joint comprising a locked position in which the pipe stacking tool is prevented from tilting about the tilt shaft, and a neutral position in which the pipe stacking tool is allowed to tilt about the tilt shaft; and a rotary arm comprising a rotary arm bore, the rotary arm being pivotally connected to the gripper head, wherein, the articulated joint is configured to allow a tilting between the pipe handling head and the gripper head, the tilt shaft is passed through the rotary arm bore, and the rotary arm is configured to turn the tilt shaft and the pipe stacking tool between the neutral position and the locked position of the articulated joint.

15. The lifting arm arrangement as recited in claim 14, wherein, the pipe stacking tool further comprises at least one bore, and the tilt shaft is supported in the gripper head and is connected to the pipe stacking tool in that the tilt shaft passes through the at least one bore.

16. The lifting arm arrangement as recited in claim 14, wherein, the rotary arm is further configured to turn the pipe stacking tool and the tilt shaft about an axial direction of the pipe stacking tool.

17. The lifting arm arrangement as recited in claim 14, further comprising:

an actuator configured to turn the rotary arm between the neutral position and the locked position of the articulated joint.

18. The lifting arm arrangement as recited in claim 14, further comprising:

a locking sleeve connected to the gripper head, the locking sleeve comprising at least one locking face; and at least one stop face arranged on the pipe stacking tool;

wherein, the at least one locking face is positioned to contact with the at least one stop face in the locked position of the articulated joint.

19. The lifting arm arrangement as recited in claim 18, wherein the locking sleeve further comprises recesses configured to receive the at least one stop face when the articulated joint is in the neutral position.

* * * * *